US010991351B2

(12) United States Patent
Sato et al.

(10) Patent No.: US 10,991,351 B2
(45) Date of Patent: Apr. 27, 2021

(54) ELECTRONIC KEYBOARD INSTRUMENT AND KEYBOARD DEVICE

(71) Applicant: Roland Corporation, Shizuoka (JP)

(72) Inventors: Hitoshi Sato, Shizuoka (JP); Yukihide Takata, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 16/566,914

(22) Filed: Sep. 11, 2019

(65) Prior Publication Data

US 2020/0111465 A1 Apr. 9, 2020

(30) Foreign Application Priority Data

Oct. 4, 2018 (JP) ..... JP2018-189462

(51) Int. Cl.

| | |
|---|---|
| ***G10C 3/12*** | (2006.01) |
| ***G10H 1/34*** | (2006.01) |
| ***G09F 15/00*** | (2006.01) |

(52) U.S. Cl.

CPC ..... *G10H 1/346* (2013.01); *G09F 15/0006* (2013.01); *G10C 3/125* (2013.01)

(58) Field of Classification Search

CPC .... G10H 1/346; G09F 15/0006; G10C 3/125; G10C 3/12

See application file for complete search history.

(56) References Cited

U.S. PATENT DOCUMENTS

| | | | | |
|---|---|---|---|---|
| 7,297,854 | B2 | 11/2007 | Nishida | |
| 7,332,663 | B2 * | 2/2008 | Nishida | G10C 3/12 84/423 R |
| 8,637,755 | B2 | 1/2014 | Osuga et al. | |
| 8,802,952 | B2 | 8/2014 | Osuga et al. | |
| 8,809,658 | B2 | 8/2014 | Osuga et al. | |
| 8,809,660 | B2 | 8/2014 | Osuga et al. | |
| 9,349,359 | B2 | 5/2016 | Takata et al. | |
| 9,646,578 | B2 | 5/2017 | Takata et al. | |

FOREIGN PATENT DOCUMENTS

| | | |
|---|---|---|
| JP | H08314441 | 11/1996 |
| JP | 2008070766 | 3/2008 |
| JP | 2008070767 | 3/2008 |
| JP | 2016018055 | 2/2016 |

* cited by examiner

*Primary Examiner* — Kimberly R Lockett
(74) *Attorney, Agent, or Firm* — JCIPRNET

(57) ABSTRACT

An electronic keyboard instrument includes at least one panel supporting member which supports a panel, the at least one panel supporting member is disposed in spaces formed on an upper surface of a chassis, and the spaces are spaces generated behind rear ends of white keys between two adjacent black keys by arranging a plurality of keys in a manner that rear ends of a plurality of black keys are positioned behind rear ends of a plurality of white keys.

20 Claims, 11 Drawing Sheets

ELECTRONIC KEYBOARD INSTRUMENT AND KEYBOARD DEVICE

CROSS REFERENCE TO RELATED APPLICATIONS

This application claims the priority benefit of Japanese Patent Application No. 2018-189462, filed on Oct. 4, 2018. The entirety of the above-mentioned patent application is hereby incorporated by reference herein and made a part of this specification.

BACKGROUND OF THE DISCLOSURE

Technical Field

The disclosure relates to an electronic keyboard instrument and a keyboard device.

Related Art

In recent years, an electronic keyboard instrument such as an electronic piano which reproduces timbre, operability, appearance and the like of an acoustic piano in a pseudo manner is widespread. A keyboard device which is used in this kind of electronic keyboard instrument may be a keyboard instrument which supports, by a back guide inserting through keys from chassis top walls and extending to a panel side, a panel which is arranged above the keys to cover a rear end side of the keys from above (for example, patent literature 1). According to this type of keyboard device, the back guide can be provided with a function of suppressing rattle of the keys and a function of supporting the panel.

LITERATURE OF RELATED ART

Patent Literature

[Patent literature 1] Japanese Laid-Open NO. 2016-18055

Problems to be Solved

In addition, in a conventional electronic keyboard instrument, a configuration in which panel supporting members for supporting a panel are arranged behind a chassis is widely employed. In a case of this configuration, spaces for mounting the panel supporting members behind the chassis are required, and there is a risk of growing in a depth size of the electronic keyboard instrument.

SUMMARY

A first aspect of the disclosure is an electronic keyboard instrument. The electronic keyboard instrument includes: a plurality of keys which is arrayed including a plurality of white keys and a plurality of black keys respectively having a front end and a rear end; a chassis which is arranged below the plurality of keys and rotatably supports the plurality of keys; a panel which is arranged above a rear end part of the plurality of keys; and at least one panel supporting member which supports the panel; wherein the at least one panel supporting member is disposed in spaces formed on an upper surface of the chassis, and the spaces are spaces generated behind rear ends of the white keys between two adjacent black keys.

A second aspect of the disclosure is a keyboard device which is a structural element of an electronic keyboard instrument. The keyboard device according to the disclosure includes: a plurality of keys which is arrayed including a plurality of white keys and a plurality of black keys respectively having a front end and a rear end; a chassis which is arranged below the plurality of keys and rotatably supports the plurality of keys; at least one space which is formed on an upper surface of the chassis and in which at least one panel supporting member for supporting a panel covering rear ends of the plurality of keys is arranged; wherein the at least one space is a space generated behind a rear end of a white key between two adjacent black keys.

DESCRIPTION OF THE EMBODIMENTS

Figure 1:
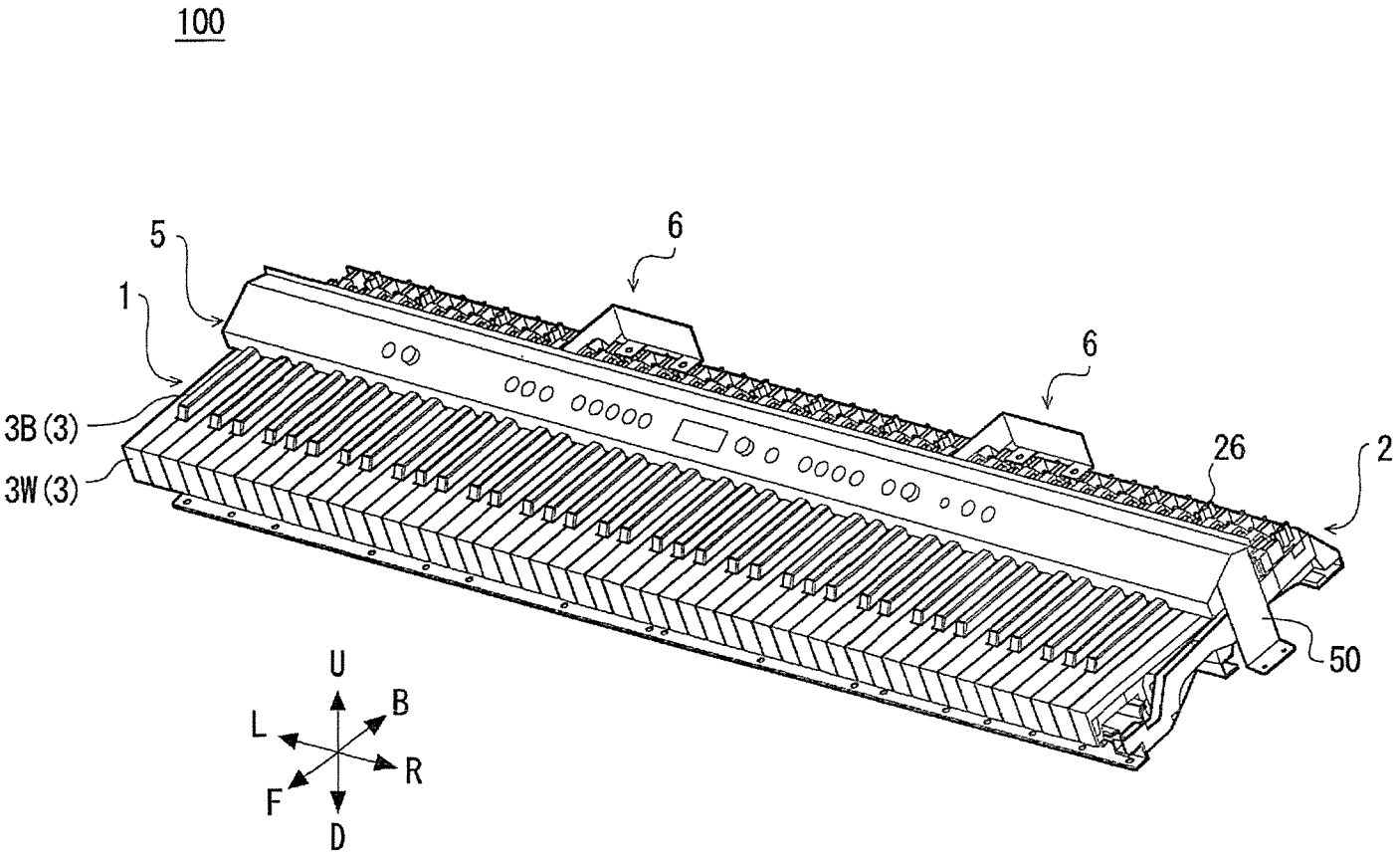
FIG. 1 is a perspective diagram of an electronic keyboard instrument according to an embodiment.
Figure 2:
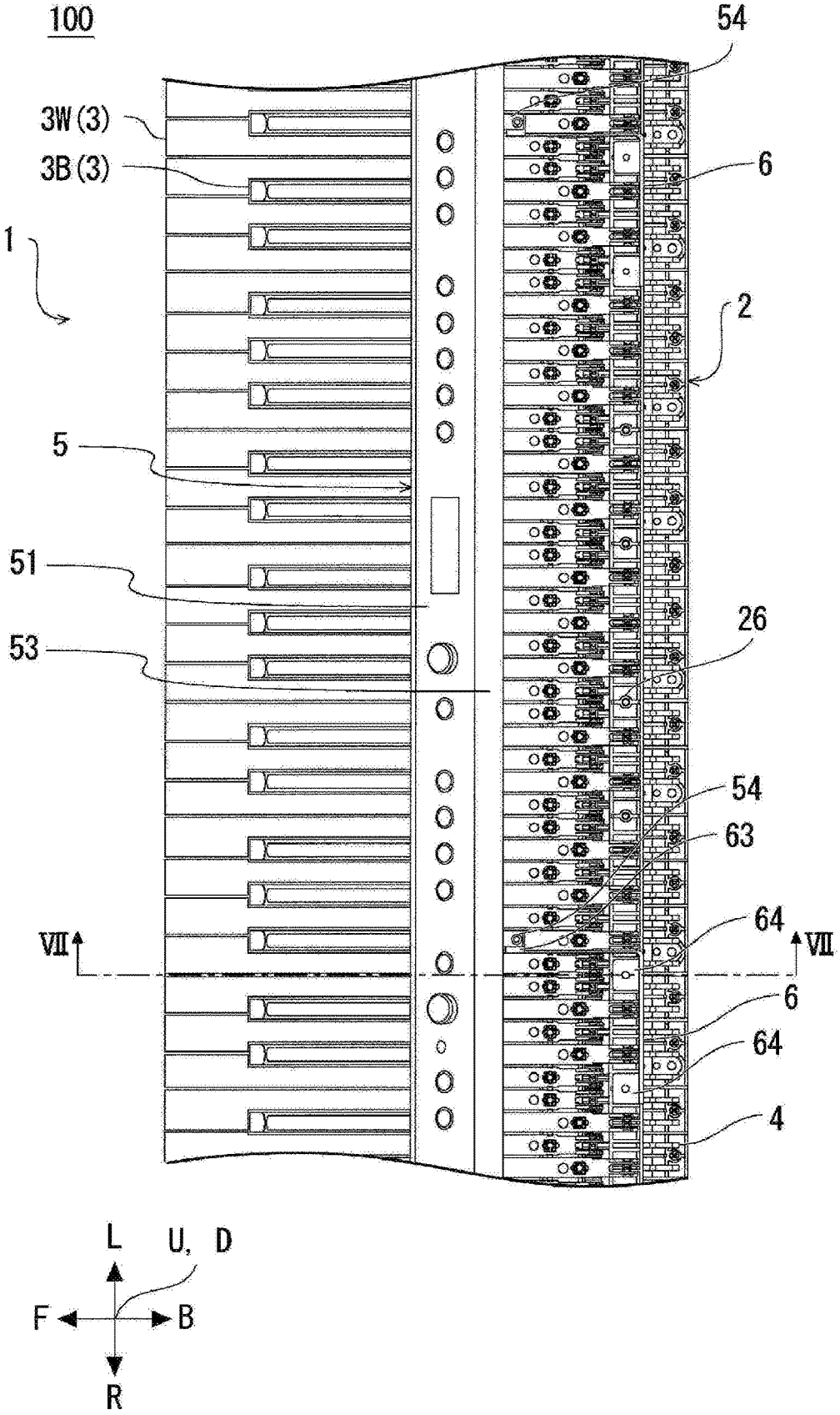
FIG. 2 is a plan view of the electronic keyboard instrument according to the embodiment.
Figure 3:
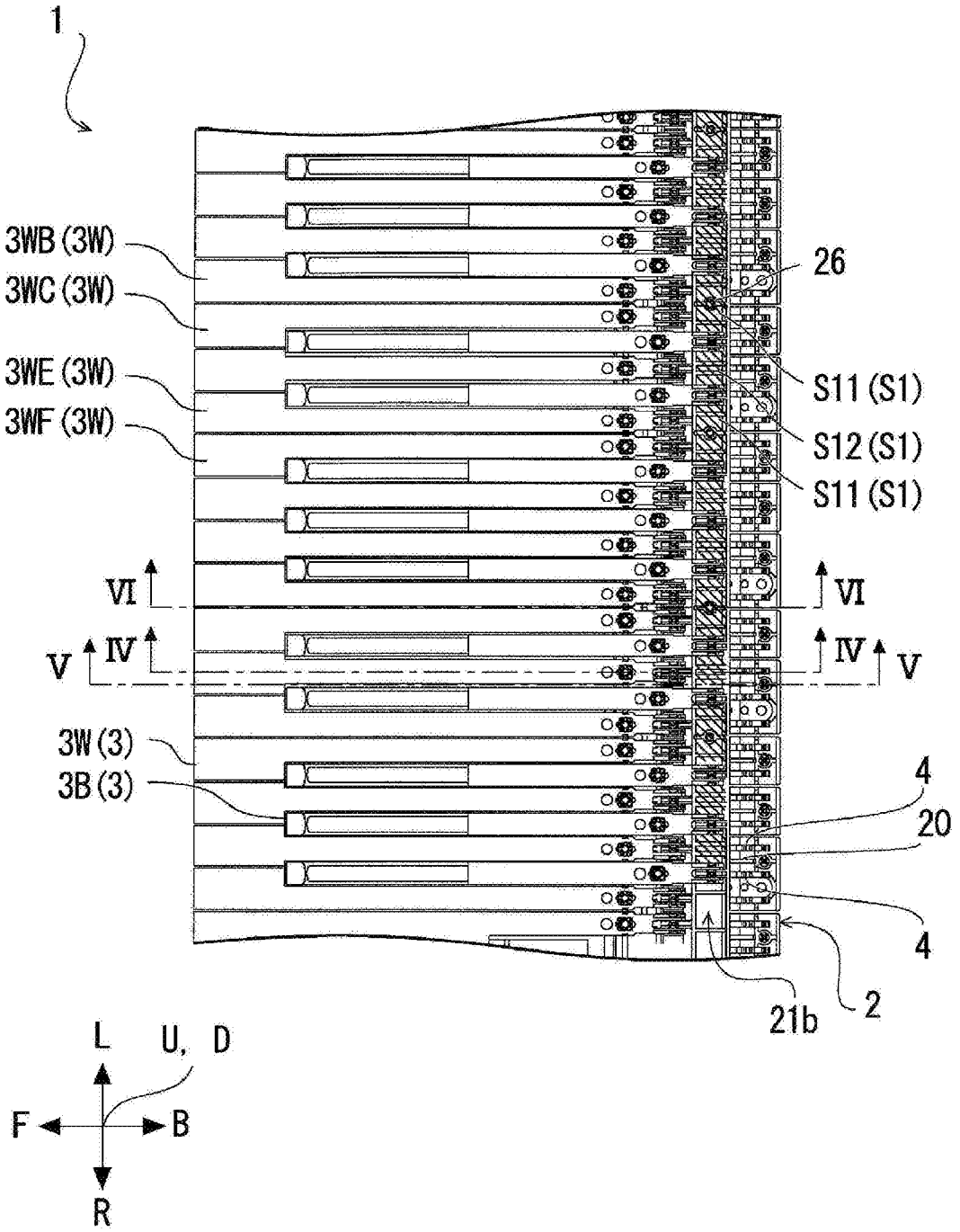
FIG. 3 is a plan view of a keyboard device according to the embodiment.
Figure 4:
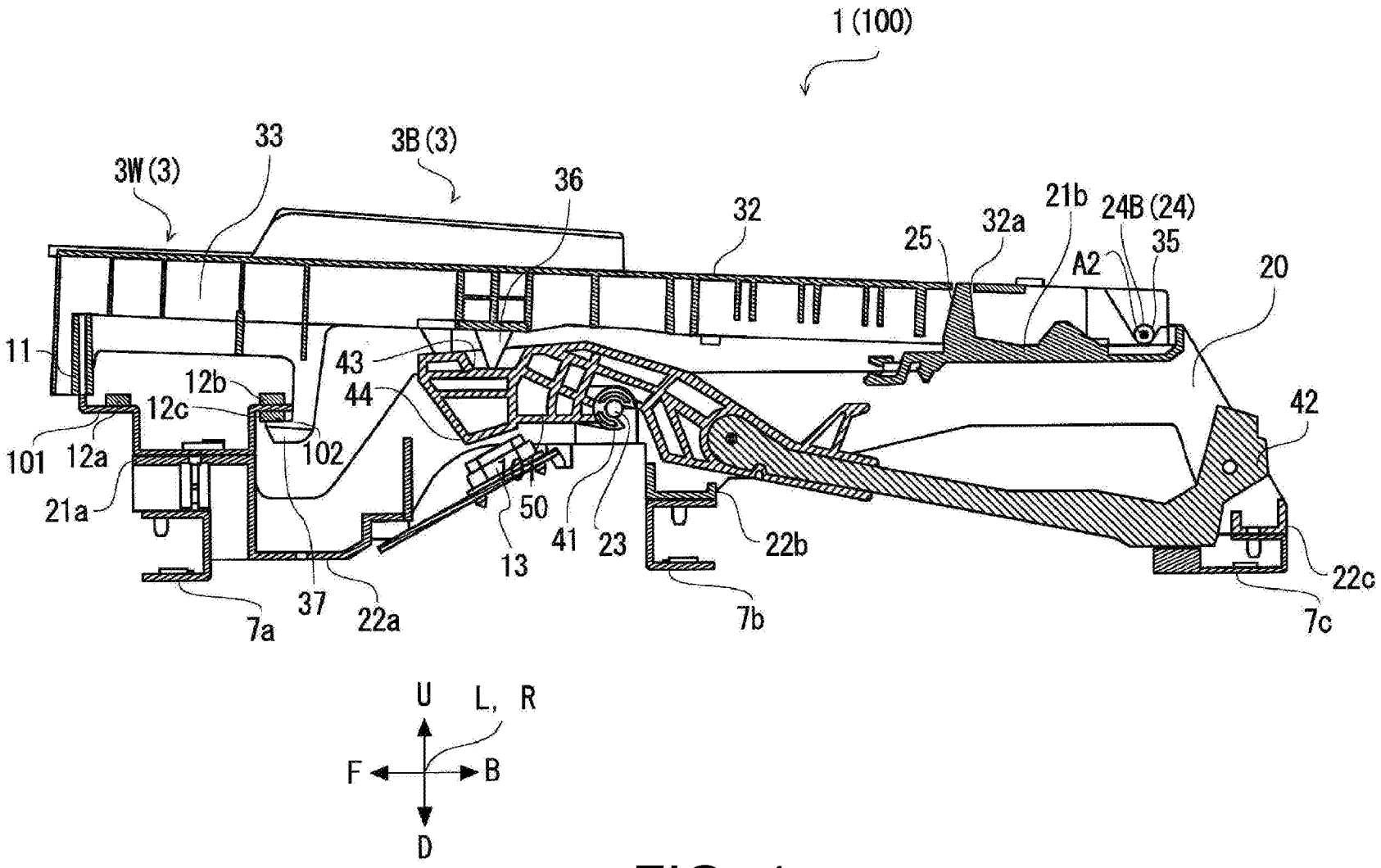
FIG. 4 is a cross-sectional view of the keyboard device along an IV-IV cross-sectional line shown in FIG. 3.
Figure 5:
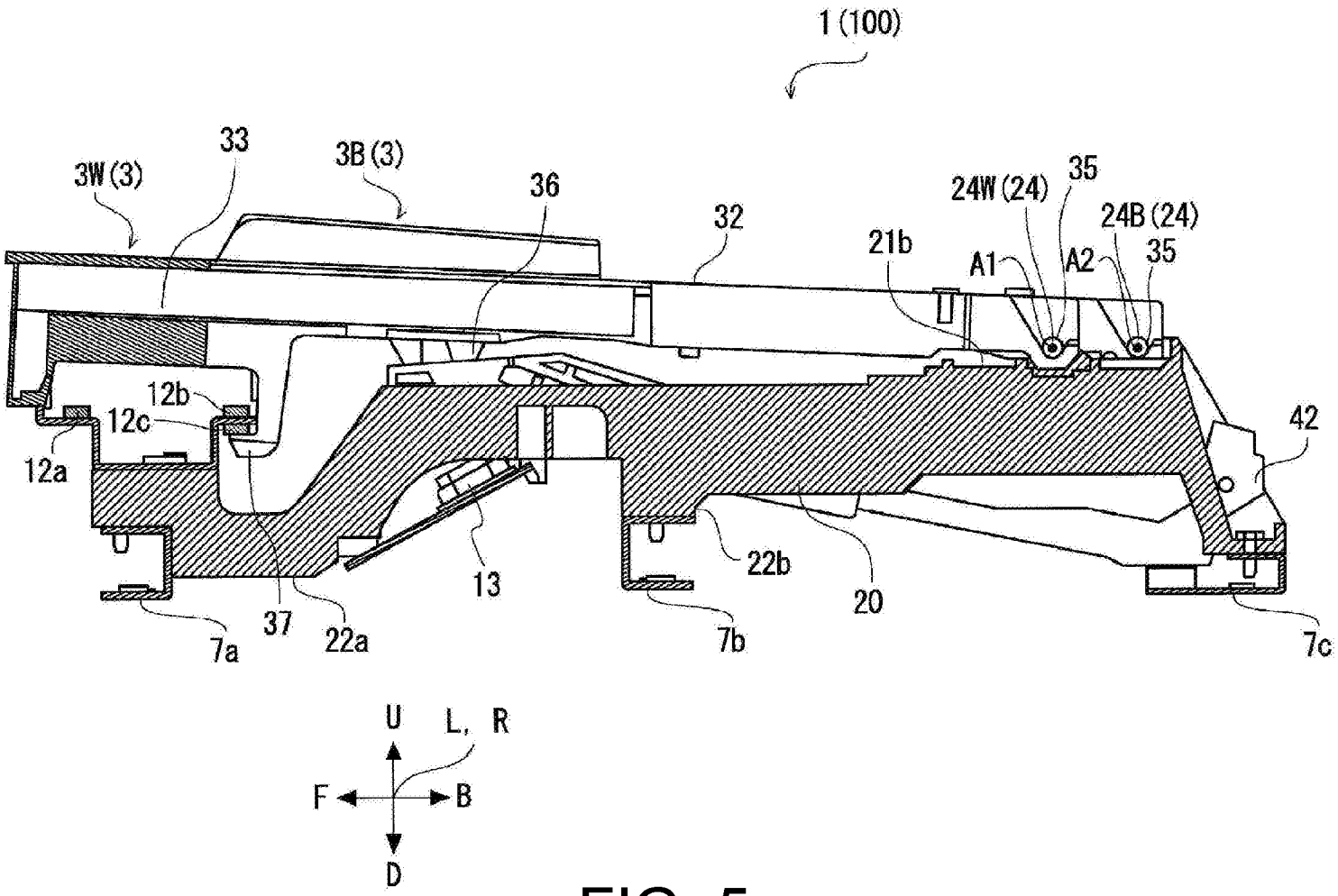
FIG. 5 is a cross-sectional view of the keyboard device along a V-V cross-sectional line shown in FIG. 3.
Figure 6:
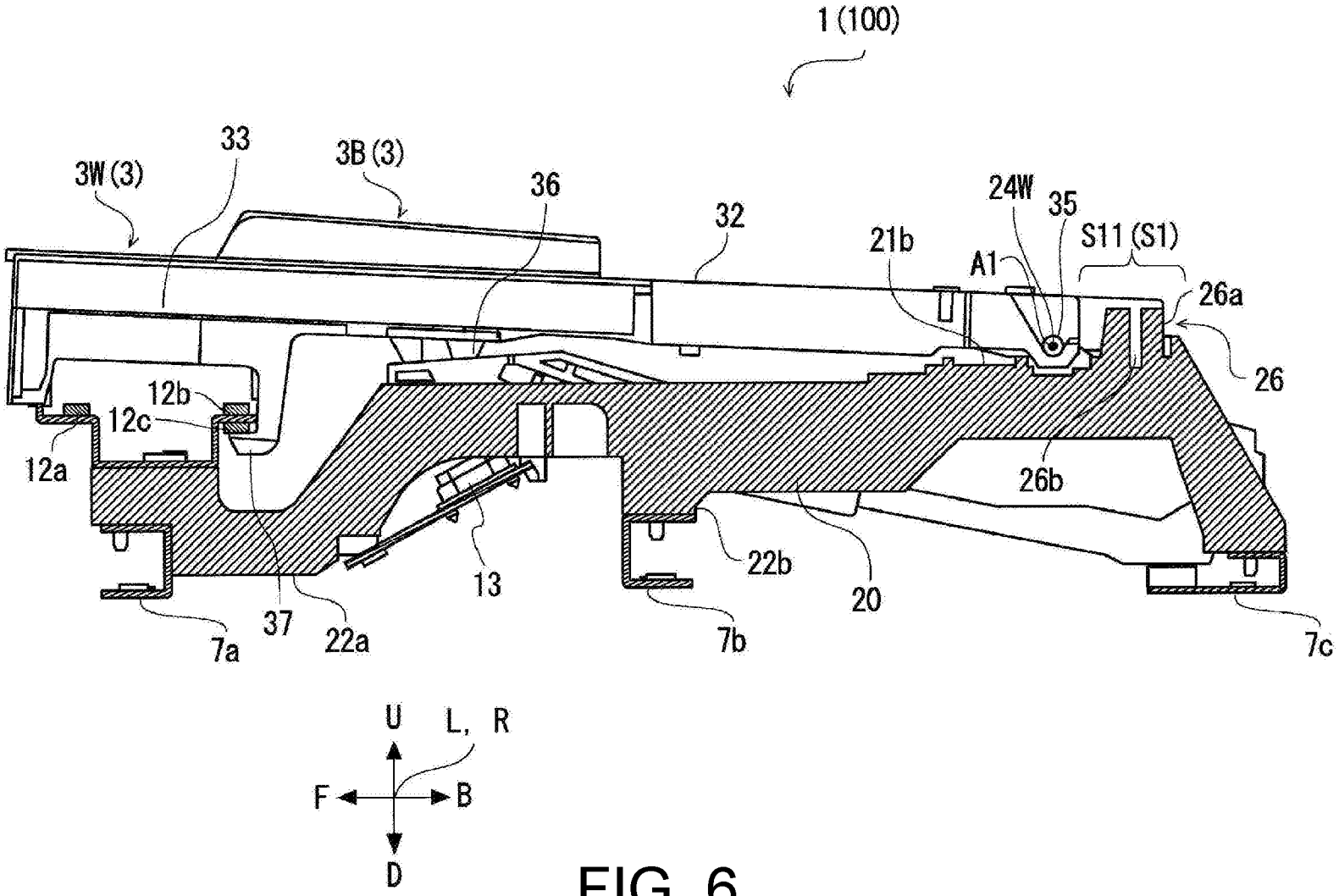
FIG. 6 is a cross-sectional view of the keyboard device along a VI-VI cross-sectional line shown in FIG. 3.
Figure 7:
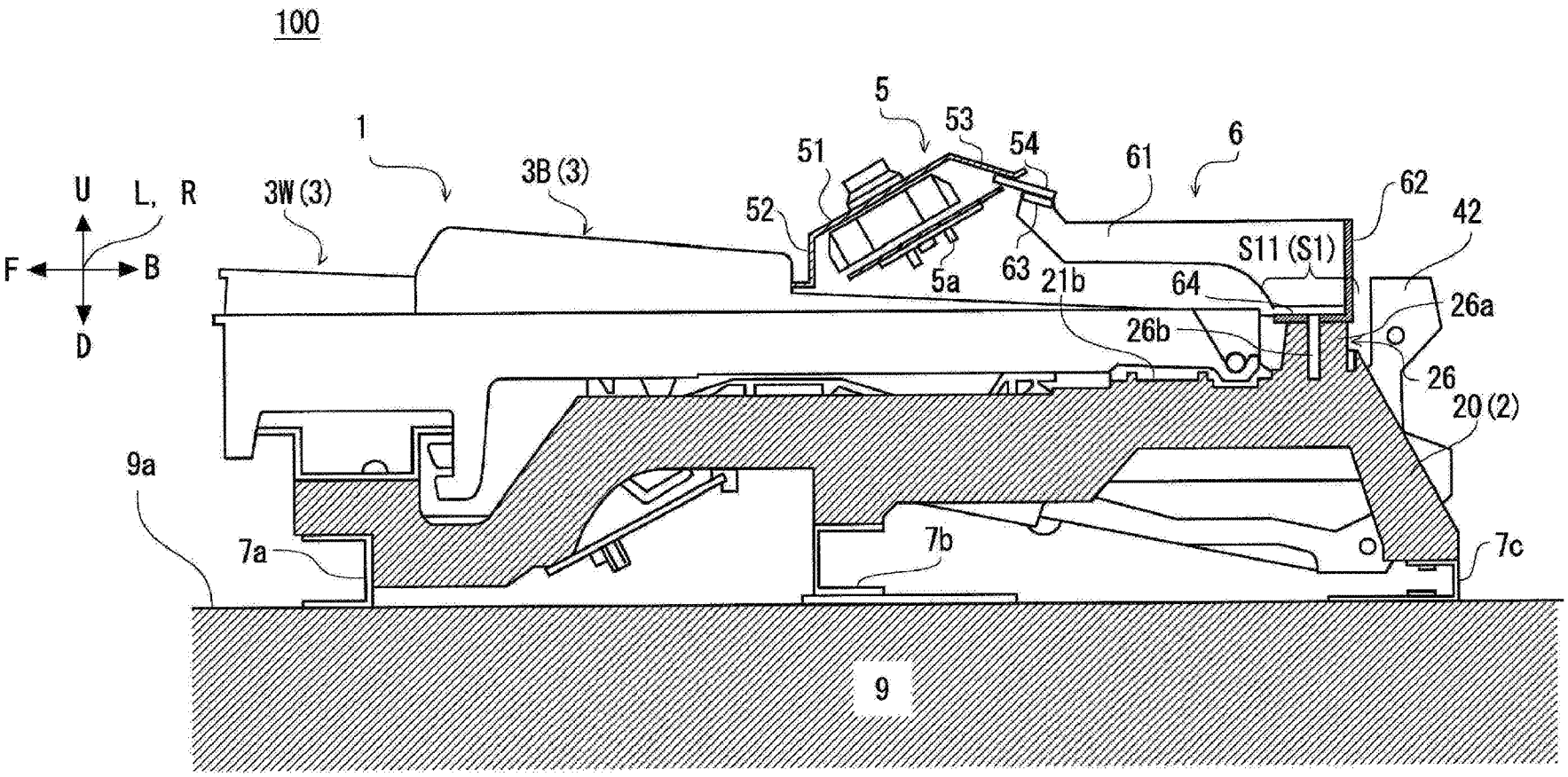
FIG. 7 is a cross-sectional view of the electronic keyboard instrument along a VII-VII cross-sectional line shown in FIG. 2.

In the following, an electronic keyboard instrument 100 according to an embodiment is described with reference to drawings. FIG. 1 is a perspective diagram of the electronic keyboard instrument 100 according to the embodiment. FIG. 2 is a plan view of the electronic keyboard instrument 100 according to the embodiment. FIG. 3 is a plan view of a keyboard device 1 according to the embodiment. In FIG. 1, FIG. 2 and FIG. 3, one portion of the configuration is omitted in the illustration. FIG. 4 is a cross-sectional view of the keyboard device 1 along a IV-IV cross-sectional line shown in FIG. 3, FIG. 5 is a cross-sectional view of the keyboard device 1 along a V-V cross-sectional line shown in FIG. 3, and FIG. 6 is a cross-sectional view of the keyboard device 1 along a VI-VI cross-sectional line shown in FIG. 3. FIG. 7 is a cross-sectional view of the electronic keyboard instrument 100 along a VII-VII cross-sectional line shown in FIG. 2. In FIG. 7, for convenience, a state in which white keys 3W in the front (an R side) is pressed is shown. In addition, a symbol 9 shown in FIG. 7 indicates a housing in which the keyboard device 1 is installed.

<Configuration>

As shown in FIG. 1 and FIG. 2, in the electronic keyboard instrument 100, a plurality of keys 3 including the white keys 3W and black keys 3B is arrayed. In the following description, an array direction of the plurality of (in the example, 88) keys 3 is referred to as a width direction (a left and right direction), and a longitudinal direction of the keys 3 is referred to as a depth direction (a front and back direction). Arrows U-D, L-R, and F-B in the diagrams respectively indicate the up and down, left and right, front and back of the electronic keyboard instrument 100. In addition, in the following description, when the keys 3 is described without distinguishing between the white keys 3W and the black keys 3B, the keys 3 are simply recited as the keys 3. In addition, for the convenience of description, if the white keys 3W are separately specified corresponding to pitch names (C, D, E . . . ), a corresponding pitch name (for example "C") is added to the end of the symbol (that is "3W") to get a symbol described as white keys 3WC.

The electronic keyboard instrument 100 generates a musical sound according to a signal output from an electronic circuit not illustrated corresponding to an operation of the keys 3. The electronic keyboard instrument 100 may be, for example, an electronic piano, an electronic organ, an electronic keyboard, a synthesizer or the like.

As shown in FIG. 1 and FIG. 2, the electronic keyboard instrument 100 includes the keyboard device 1. The keyboard device 1 has a chassis 2, the keys 3 which are rotatably and pivotally supported on the chassis 2, and hammers 4 which are accommodated in the chassis 2 and rotate in conjunction with key pressing and key releasing of the keys 3. In addition, the electronic keyboard instrument 100 further includes a panel 5 which is arranged above the keys 3 and panel supporting members 6 for supporting the panel 5.

The chassis 2 is arranged below the keys 3 and pivotably supports the keys 3, and are formed by steel plates or the like or a resin material in a block of a predetermined width unit. As shown in FIG. 4, the chassis 2 has a chassis body 20, chassis top walls 21*a*, 21*b*, and chassis bottom walls 22*a*, 22*b*, 22*c*.

The chassis body 20 has a plate shape orthogonal to the width direction and is disposed as shown in FIG. 2 between adjacent keys 3 (adjacent hammers 4) below the keys 3. In addition, as shown in FIG. 4, a hammer pivot 23 for pivotally supporting the hammer 4 protrudes at a central portion in a depth direction of the chassis body 20*d*.

The chassis top wall 21*a* shown in FIG. 4 connects upper edges of adjacent chassis bodies 20 with each other near a front end portion. Hardware 10 made from metal is fixed to the chassis top wall 21*a*. The hardware 10 has a front flange 101 extending forward and a rear flange 102 extending backward, and in a front end of the front flange 101, a front guide 11 is disposed. The front guide 11 is disposed on each key 3 and erected to extend upward. In addition, on an upper surface of the front flange 101, a cushioning material 12*a* is attached, and on upper and lower surfaces of the rear flange 102, cushioning materials 12*b*, 12*c* are attached. These cushioning materials 12*a*, 12*b*, 12*c* function as shock absorbing materials or sound deadening materials during the key pressing and the key releasing and are configured from felt, urethane foam or the like.

The chassis top wall 21*b* shown in FIG. 5 connects upper edges of adjacent chassis bodies 20 with each other near rear end portions. On the chassis top wall 21*b*, a key pivot portion 24 is disposed. The key pivot portion 24 is disposed on each key 3 and pivotally supports each key 3. The key pivot portion 24 has a cylindrical shape of which a central axis is parallel to the width direction. Symbols A1, A2 in FIG. 5 indicate pivots of the white key 3W and the black key 3B. Herein, as shown in FIG. 5, in the electronic keyboard instrument 100 according to the embodiment, a key pivot portion 24B for pivotally supporting the black key 3B is arranged behind a key pivot portion 24W for pivotally supporting the white key 3W in the depth direction. That is, the pivot A2 is arranged behind the pivot A1. In addition, as shown in FIG. 4, on the chassis top wall 21*b*, a back guide 25 for suppressing rattle in the width direction of the key 3 is disposed. The back guide 25 is disposed on each key 3 and is erected to extend upward in a position in front of the key pivot portion 24. In addition, as shown in FIG. 6, a mounting portion 26 for mounting the panel supporting member 6 is disposed. The mounting portion 26 is described later in detail.

The chassis bottom walls 22*a*, 22*b*, 22*c* shown in FIG. 4 connect lower edges of adjacent chassis bodies 20 with each other respectively near front end portions, central portions, and rear end portions. Base members 7*a*, 7*b*, 7*c* made of metal and formed into a U-shape in a cross sectional view are fixed to lower surfaces of the chassis bottom walls 22*a*, 22*b*, 22*c*. The chassis 2 is fixed to a bottom surface 9*a* of a housing 9 of the electronic keyboard instrument 100 via the base members 7*a*, 7*b*, 7*c* (see FIG. 7).

As shown in FIG. 3, the plurality of keys 3 including the white keys 3W and the black keys 3B has front ends and rear ends and is arranged on upper surfaces of the chassis top walls 21*a* side by side in the width direction. The keys 3 include front end parts and rear end parts, the front end parts are parts in front of the panel 5 and visible to a player, and the rear end parts are parts behind the panel 5. Besides, a basic structure of the keys 3, a structure in which the keys 3 are pivotally supported (supported), and a structure in which the hammers 4 are rotated in conjunction with the key pressing or the key releasing of the keys 3 are substantially the same for both the white keys 3W and the black keys 3B. Therefore, the structure of the keys 3 is described below using the structure of the white key 3W shown in FIG. 4 as an example, and the description of the structure of the black keys 3B is omitted.

The key 3 is made of a resin material. The key 3 is formed into an approximately U-shaped cross section with the lower part being opened. The key 3 has a top wall 32 extending in the depth direction, a pair of side walls 33 hanging from two side edges in a width direction of the top wall 32, and a front wall 34 hanging from a front edge of the top wall 32. The front guide 11 disposed on the chassis 2 is accepted between the pair of side walls 33. In addition, a penetration hole 32*a* in which the back guide 25 formed in the chassis top wall 21*b* is accepted penetrates the top wall 32 of the key 3. In this way, by the front guide 11 and the back guide 25, the key 3 is suppressed from rattling in the width direction.

Bearing holes 35 are formed near rear end portions of the side walls 33. The key pivot portion 24 formed on the chassis top wall 21*b* is inserted through the bearing holes 35. In this way, the key 3 is pivotally supported by the key pivot portion 24 via the bearing holes 35 and is rotatable around the key pivot portion 24. In addition, stopper portions 37 having an approximately L-shape in a side view are formed on lower edges of front end portion sides of the side walls 33. In addition, on lower edges between the bearing holes 35 and the stopper portions 37 in the depth direction of the side walls 33, engagement protrusions 36 having an approximately pointed shape protrude downward. When the key 3 is pressed, a front end portion of the key 3 and the engagement protrusions 36 are lowered and the key 3 rotates around the key pivot portion 24. At this time, when the key 3 is pressed, the side walls 33 of the key 3 collide with the cushioning materials 12*b*, 12*c*, and when the key 3 is released, the stopper portion 37 of the key 3 collides with the cushioning material 12*a*. In this way, shock with the key 3 is absorbed and a sound generated upon collision is suppressed.

The hammer 4 is used to apply the same touch weight as the acoustic piano by rotating in conjunction with the key pressing or the key releasing of the key 3 and is accommodated between adjacent chassis bodies 20 below each key 3. The hammer 4 is formed by insert-molding a metal member in a resin material. As shown in FIG. 4, the hammer 4 has a hammer body 40, a bearing 41, a weight portion 42, an engagement groove 43 and a switch protrusion 44.

The hammer body 40 has a shape of clamping the bearing 41 and extending on both sides in the depth direction. The bearing 41 having a C-shape in sectional view is arranged in the hammer body 40 and is pivotally supported by the hammer pivot 23 protruding in the chassis body 20. The bearing 41 is fitted into the hammer pivot 23, and thereby the hammer 4 is rotatable centering on the hammer pivot 23. The weight portion 42 is connected to a rear end portion of the hammer body 40 and has a shape extending rearward. The engagement groove 43 is formed on an upper surface of a front end portion side and is engaged with the engagement protrusion 36 arranged on the key 3 during the key pressing of the key 3. The hammer 4 rotates so that a front end portion of the hammer body 40 is lowered by the engagement between the engagement protrusion 36 and the engagement groove 43 during the key pressing of the key 3. In this way, a predetermined touch weight corresponding to a weight of the weight portion 42 is applied during the key pressing of the key 3, and the key 3 is lifted upward by the weight of the weight portion 42 during the key releasing. Herein, during the key pressing of the key 3, the weight portion 42 protrudes upward relative to the chassis body 20 due to the lifting of the weight portion 42 (see FIG. 7).

As shown in FIG. 4, below the chassis 2, a switch 13 for detecting key pressing information of the key 3 is arranged in a posture to face a lower surface on the front end portion side of the hammer body 40. On the lower surface of the front end portion side of the hammer body 40, the switch protrusion 44 protrudes toward the switch 13. Therefore, if the hammer 4 rotates centering on the hammer pivot 23 in conjunction with the key pressing of the key 3, the switch 13 is turned on by the switch protrusion 44, and the switch 13 is turned off in conjunction with the key releasing of the key 3. In this way, the key pressing, the key releasing and the like of the key 3 can be detected.

The panel 5 is a plate-like member disposed above the keys 3 and covering the rear of the keys 3 from above. The panel 5 is disposed extending in the width direction to overpass the chassis 2. As shown in FIG. 7, the panel 5 has a panel body 51, a first cover portion 52, and a second cover portion 53. The panel body 51 is inclined lowering toward the front so as to face the player. The first cover portion 52 hangs from a front edge of the panel body 51 to the vicinity of the upper surfaces of the keys 3. The second cover portion 53 is inclined so as to lower from a rear edge of the panel body 51 toward the rear.

As shown in FIG. 2, on an upper surface of the panel body 51, various display devices for displaying various states, or various operators for accepting operations of the player and performing volume adjustment, mode change or the like are arranged. In addition, as shown in FIG. 7, an electronic circuit 5*a* connected to the display devices or the operators arranged on the panel body 51 is arranged on a plate 8 disposed on an inner surface of the panel body 51. By the first cover portion 52 and the second cover portion 53, the plate 8 and the like disposed on the inner surface of the panel body 51 are covered and concealed.

As shown in FIG. 2, a pair of panel-side connection portions 54, 54 is disposed at a predetermined interval in the width direction in a middle portion of the width direction of a rear edge of the second cover portion 53. Penetration holes for connecting to the panel supporting members 6 are formed in each of the pair of panel-side connection portions 54, 54.

As shown in FIG. 1, the panel 5 is fixed to panel fixing members 50, and the chassis 2 is between the panel fixing members 50, herein only one panel fixing member 50 is indicated with a numerical reference number 50 in the right side of FIG. 1 since the other panel fixing member 50 is hidden by the chassis 2 in the viewing angle of FIG 1. In addition, the panel 5 is supported by a pair of panel supporting members 6 connected to the pair of panel-side connection portions 54, 54 in the middle portion in the width direction.

As described above, the pivots A2 of the black keys 3B are arranged in the depth direction behind the pivots A1 of the white keys 3W. In addition, a distance from the pivots A1 to the rear ends of the white keys 3W is equal to a distance from the pivots A2 to the rear ends of the black keys 3B. Therefore, as shown in FIG. 2 and FIG. 3, the plurality of keys 3 is arrayed in a manner that the rear ends of the black keys 3B are positioned in front of the rear ends of the white keys 3W. In this way, on the upper surfaces of the chassis top walls 21*b*, arrangement spaces S1 which are spaces for arranging the panel supporting members 6 are formed. The arrangement spaces S1 are spaces generated behind the white keys 3W between two adjacent black keys 3B, 3B. In FIG. 3, the arrangement spaces S1 are shown by diagonal hatchings. The arrangement spaces S1 are arrayed along the width direction, and the arrangement spaces S1 adjacent in the width direction are partitioned by the black keys 3B. The arrangement spaces S1 is between two black keys 3B, 3B and two white keys 3WB, 3WC are between the two black keys 3B, 3B. The arrangement spaces S1 is between two black keys 3B, 3B and two white keys 3WE, 3WF are between the two black keys 3B, 3B and formed with wider widths compared with the other arrangement spaces S1. The arrangement spaces S1 with a comparatively wider width are called arrangement spaces S11, and the other arrangement spaces S1 with a comparatively narrower width are called arrangement spaces S12.

As shown in FIG. 3, by forming the arrangement spaces S1, the upper surfaces of the chassis top walls 21*b* are in a state of not being covered by the keys 3 in the arrangement spaces S1. Herein, as shown in FIG. 3, on the upper surfaces of the chassis top walls 21*b*, the mounting portions 26 are formed to be arranged in each arrangement space S11. The mounting portions 26 are places to which the panel supporting members 6 can be mounted. As shown in FIG. 6, the mounting portions 26 have bosses 26*a* protruding upward from the upper surfaces of the chassis top walls 21*b* and screw holes 26*b* formed on upper end surfaces of the bosses 26*a*. The screw holes 26*b* can accept screws for connecting the panel supporting members 6 to the mounting portions 26 and are formed downward from the upper end surfaces of the bosses 26*a*.

Figure 8A:
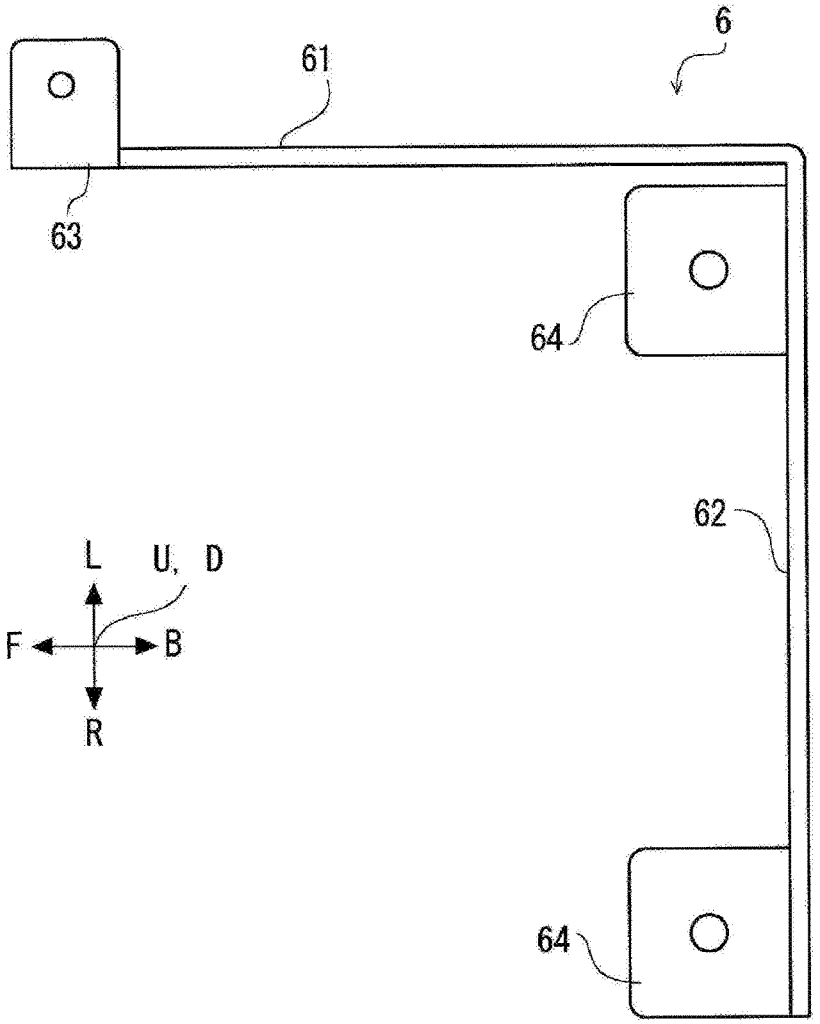
FIG. 8A is a top view of a panel supporting member.
Figure 8B:
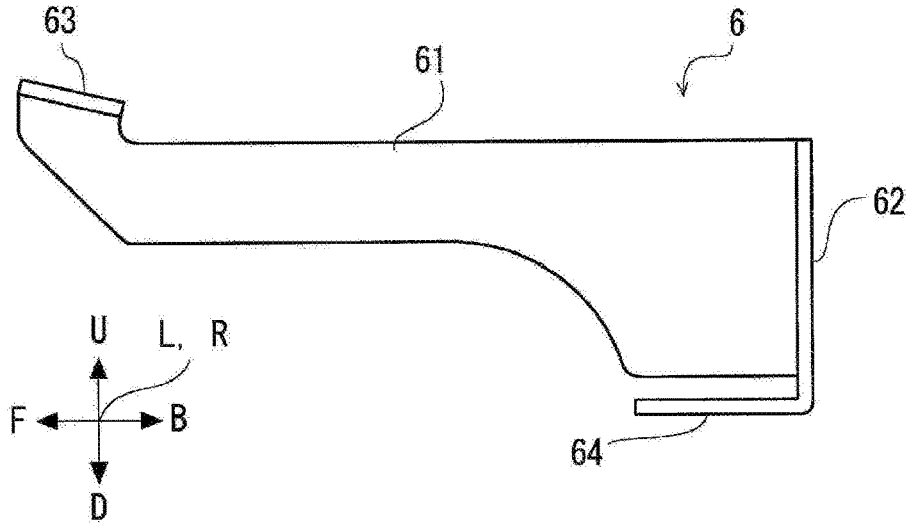
FIG. 8B is a side view of the panel supporting member.

Next, the panel supporting member 6 is described. FIG. 8A is a top view of the panel supporting member 6, and FIG. 8B is a side view of the panel supporting member 6. The panel supporting member 6 is formed by bending a sheet metal and is formed into an appropriately L-shape in a top view. As shown in FIG. 8A, the panel supporting member 6 has a first extension portion 61 extending in the depth direction in a posture orthogonal to the width direction, and a second extension portion 62 extending from a rear edge of the first extension portion 61 to the right of the width direction in a posture orthogonal to the depth direction. A first connection portion 63 connected to a panel-side connection portion 54 of the panel 5 extends on an upper edge near a front end portion of the first extension portion 61. In the first connection portion 63, a penetration hole for connecting to the panel-side connection portion 54 is formed. On a lower edge of the second extension portion 62, a pair of second connection portions 64, 64 connected to the mounting portion 26 extends in the width direction with a predetermined interval. The second connection portions 64 extend forward from the lower edge of the second extension portion 62.

The aforementioned panel supporting members 6 are mounted to the chassis 2 using any two mounting portions 26 of the plurality of mounting portions 26 arranged in the keyboard device 1. More specifically, by connecting the second connection portions 64 and the mounting portions 26 using screws (not illustrated), the panel supporting members 6 are mounted to the chassis 2. Moreover, by connecting the first connection portions 63 and the panel-side connection portions 54 using fastening members such as screws or the like, the panel 5 is supported by the panel supporting members 6. Besides, as shown in FIG. 7, a lower edge of the first extension portion 61 is notched in a curve so as not to interfere with the key 3. In this way, by the panel supporting members 6, the middle portion in the width direction of the panel 5 is supported from below. Accordingly, rigidity of the panel 5 is improved, and the panel 5 is suppressed from bending due to the pressing at the time when the player operates the operators on the panel 5 or the like.

Figure 9:
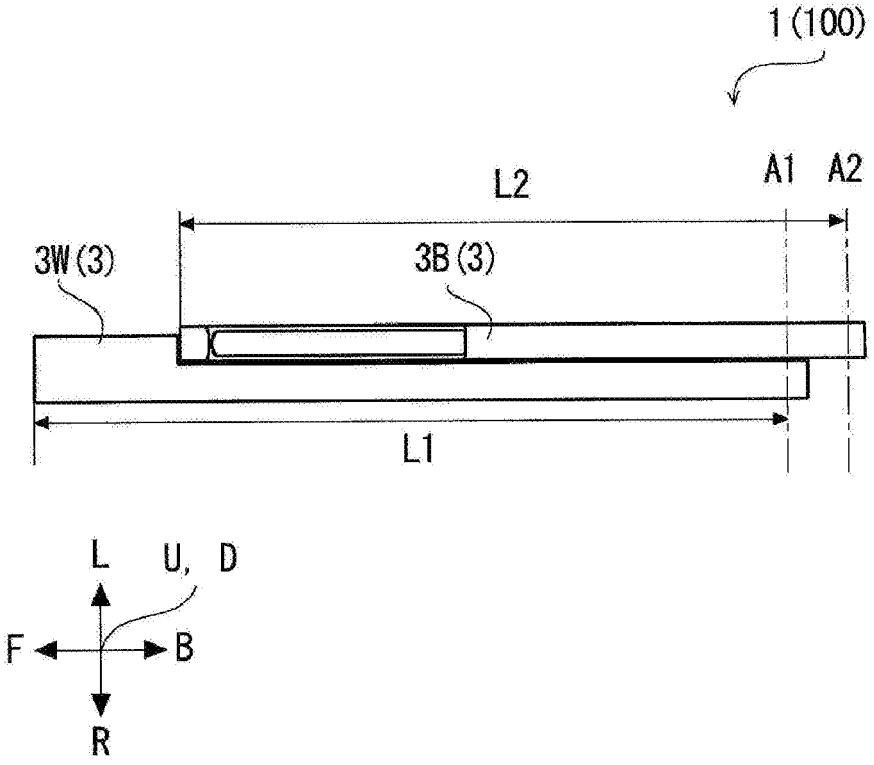
FIG. 9 is a plan view showing a positional relationship between a white key and a black key in the electronic keyboard instrument according to the embodiment.

FIG. 9 is a plan view showing a positional relationship between the white key 3W and the black key 3B in the electronic keyboard instrument 100 according to the embodiment. In FIG. 9, for convenience, the key 3 is simplified to be illustrated. In addition, symbols L1, L2 in FIG. 9 indicate a length from the pivot A1 of the white key 3W to the front end of the white key 3W and a length from the pivot A2 of the black key 3B to the front end of the black key 3B in the electronic keyboard instrument 100. In the following, an advantage of the electronic keyboard instrument 100 in a case that L1 and L2 are lengthened is described.

When the L1 and the L2 are lengthened, a depth size (a front and back width) of the chassis 2 (that is, the keyboard device 1) is also lengthened along with lengthening of the keys 3. At this time, in the electronic keyboard instrument 100, because the panel supporting members 6 are mounted to the upper surface of the chassis 2 or above the chassis 2, there is no need for an installation space of the panel supporting members 6 behind the keyboard device 1. Therefore, in a limited space inside the housing, L1 and L2 can be lengthened without being restricted by the installation space of the panel supporting members 6. Herein, lengths from pivots to front ends of white keys and black keys in the acoustic piano are respectively set as L3, L4. In the electronic keyboard instrument, by making the lengths from the pivots to the front ends of the white keys and the black keys close to L3 and L4, there is a tendency that an operation feeling similar to the acoustic piano is obtained. In the electronic keyboard instrument 100, L1 and L2 can be lengthened to respectively approach L3 and L4 without being restricted by the installation space of the panel supporting members 6. As a result, the operation feeling similar to the acoustic piano can be obtained. However, lengths of L1 and L2 are not limited hereto.

<Operation and Effect>

Figure 10:
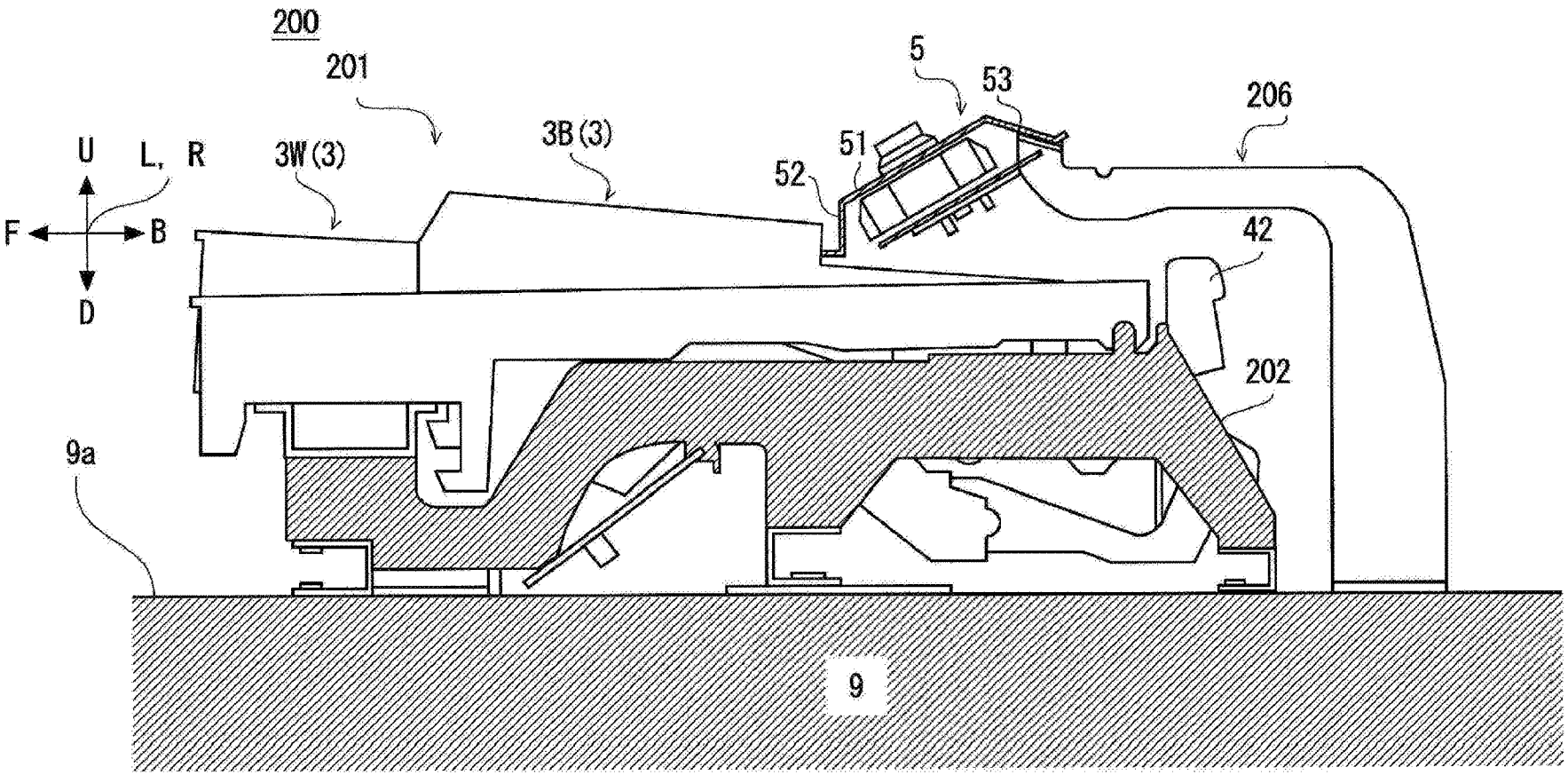
FIG. 10 is a diagram corresponding to FIG. 7 and is a cross-sectional view showing an electronic keyboard instrument according to a comparison example.
Figure 11:
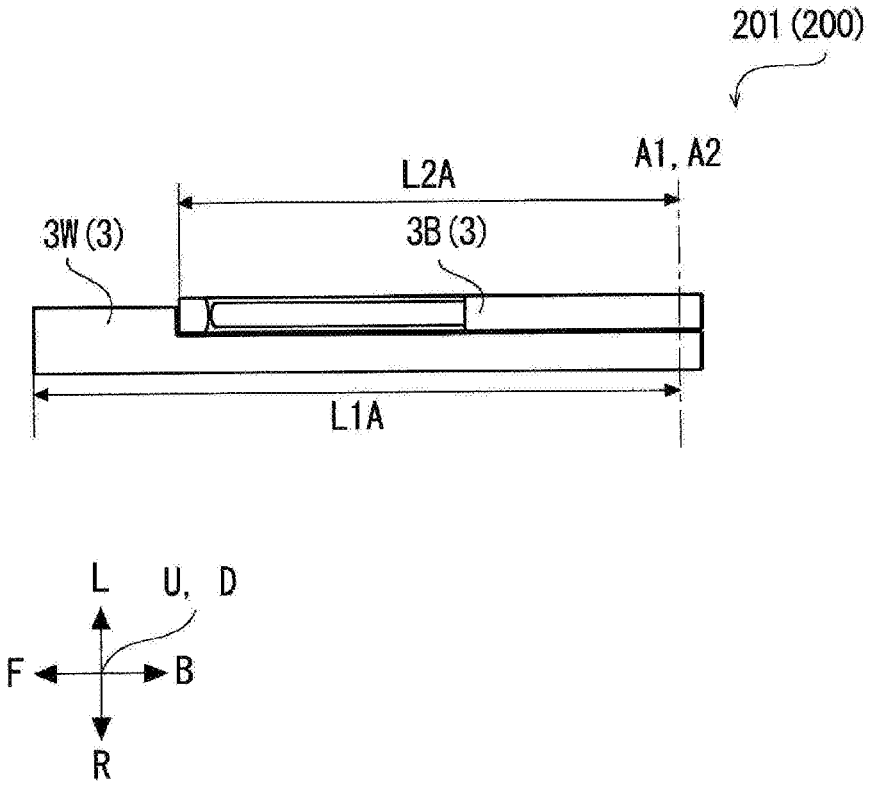
FIG. 11 is a diagram corresponding to FIG. 9 and is plan view showing a positional relationship between a white key and a black key in the electronic keyboard instrument according to the comparison example.

Next, in comparison with an electronic keyboard instrument 200 according to a comparison example, operation and effect of the electronic keyboard instrument 100 according to the embodiment is described. FIG. 10 is a diagram corresponding to FIG. 7 and is a cross-sectional view showing the electronic keyboard instrument 200 according to the comparison example. In addition, FIG. 11 is a diagram corresponding to FIG. 9 and is a plan view showing a positional relationship between a white key 3W and a black key 3B in the electronic keyboard instrument 200 according to the comparison example. In addition, symbols L1A, L2A in FIG. 11 indicate a length from a pivot A1 of the white key 3W to a front end of the white key 3W and a length from a pivot A2 of the black key 3B to a front end of the black key 3B in the electronic keyboard instrument 200. As shown in FIG. 10, different from the electronic keyboard instrument 100, in the electronic keyboard instrument 200 according to the comparison example, a panel supporting member 206 is mounted on a bottom surface 9*a* of a housing 9 and behind a keyboard device 201 (a chassis 202). In addition, as shown in FIG. 11, different from the electronic keyboard instrument 100, in the electronic keyboard instrument 200, front and back positions of the rear ends and the pivots are the same in the white keys 3W and the black keys 3B.

As shown in FIG. 10, in the electronic keyboard instrument 200 according to the comparison example, because the panel supporting member 206 is arranged behind the chassis 202, a space for mounting the panel supporting member 206 behind the chassis 202 (the keyboard device 201) is required.

In contrast, in the electronic keyboard instrument 100, the plurality of keys 3 is arrayed in a manner that the rear ends of the plurality of black keys 3B are positioned behind the rear ends of the plurality of white keys 3W, and thereby the arrangement spaces S1 are generated behind the rear ends of the white keys 3W between two adjacent black keys 3B, 3B. Moreover, in the electronic keyboard instrument 100, the panel supporting members 6 are arranged in the arrangement spaces S1 formed on the upper surface of the chassis 2. In this way, the panel supporting members 6 for supporting the panel 5 can be arranged on the upper surface of the chassis 2. That is, spaces for mounting the panel supporting members 6 behind the keyboard device 1 are not required. Therefore, compared with the electronic keyboard instrument 200 according to the comparison example in which the panel supporting members 206 are arranged behind the chassis 202, the depth size of the electronic keyboard instrument can be reduced. By reducing the depth size, the electronic keyboard instrument 100 can appeal to a user who wants a room for arranging an electronic keyboard instrument to look even if only slightly wider.

In addition, in the electronic keyboard instrument 200 according to the comparison example, because the panel supporting members 206 are arranged behind the chassis 202, the panel supporting members 206 are required to be a shape that extends from the rear of the chassis 202 to the top of the keys 3. More specifically, a height of the panel supporting members 206 is required to be higher than the chassis 202, and a depth is required to be longer than a distance between the rear ends of the chassis 202 and the panel 5. In contrast, in the electronic keyboard instrument 100, by arranging the panel supporting members 6 on the upper surface of the chassis 2, the height and the depth of the panel supporting members 6 can be smaller than the panel supporting members 206 of the comparison example. As a result, the rigidity of the panel supporting members can be improved and a material cost can be reduced.

In addition, the arrangement spaces S1 are spaces generated behind the rear ends of the white keys 3W between two adjacent black keys 3B, 3B, and thus spaces having a width of at least one white key 3W can be secured as the spaces for arranging the panel supporting members 6. In addition, the electronic keyboard instrument 100 employs a configuration in which the panel supporting members 6 for supporting the panel 5 are arranged on the chassis 2 (the keyboard device 1), and thus the panel 5 is connected to the keyboard device 1 via the panel supporting members 6. Therefore, there is also an advantage that an accuracy of a relative position between the keyboard device 1 and the panel 5 can be improved compared with a case when the panel supporting members 6 are mounted to the housing 9.

Besides, in the electronic keyboard instrument 100, at least one arrangement space S1 is formed. However, in the electronic keyboard instrument 100 according to the embodiment, a plurality of (two in the example) arrangement spaces S1 is used for arranging the panel supporting members 6. Therefore, the panel supporting members 6 can be more firmly arranged on the chassis 2. Furthermore, the electronic keyboard instrument 100 is configured to support the panel 5 by a plurality of the panel supporting members 6. In this way, the panel 5 can be supported more securely than a case when the panel 5 is supported by a single panel supporting member 6. As a result, the rigidity of the panel 5 can be further improved. However, the electronic keyboard instrument 100 may include at least one panel supporting member 6.

Herein, a difference between L1 and L2 shown in FIG. 9 is set as δL, and a difference between L1A and L2A shown in FIG. 11 is set as δLA. In the electronic keyboard instrument 100, the keys 3 are arrayed in a manner that the pivots A2 of the black keys 3B are positioned behind the pivots A1 of the white keys 3W, and in the electronic keyboard instrument 200, the front and back positions of the pivots A1 of the white keys 3W and the pivots A2 of the black keys 3B coincide with each other. Therefore, SL is smaller than δLA. Herein, when the difference between the length from the pivots A1 to the front ends of the white keys 3W and the length from the pivots A2 to the front ends of the black keys 3B is larger, there is a tendency that stroke and touch weight during the key pressing are more difficult to be aligned in the white keys 3W and the black keys 3B. According to the electronic keyboard instrument 100, by arraying the keys 3 in a manner that the pivots A2 of the black keys 3B are positioned behind the pivots A1 of the white keys 3W, $\delta L<\delta LA$ can be established. In this way, the stroke and the touch weight during the key pressing of the white keys 3W and the black keys 3B can be aligned more easily than in the case of the electronic keyboard instrument 200. As a result, an operation feeling more similar to the acoustic piano can be obtained.

In addition, the panel supporting members 6 are mounted to the upper surface of the chassis 2 using the mounting portions 26 formed in the arrangement spaces S1. In this way, the panel supporting members 6 can be detachable to the chassis 2. In addition, by setting the panel supporting members 6 and the chassis 2 as separate components, in view of a load supported by the panel supporting members 6 or the rigidity that the panel supporting members 6 should have, a material different from the chassis 2 can be applied to the panel supporting members 6. The mounting portions 26 have the screw holes 26*b* for accepting the screws used to connect the panel supporting members 6 to the mounting portions 26. In this way, the panel supporting members 6 can be mounted by a simple configuration. Besides, the panel supporting members 6 may be mounted using only one mounting portion 26 among the plurality of mounting portions 26. In that case, for example, a plurality of bosses 26*a* and screw holes 26*b* may be arranged on the mounting portions 26.

Nevertheless, as long as the panel 5 can be properly supported, the panel supporting members 6 may be formed integrally with the chassis 2 and arranged in the arrangement spaces S1. By integrating the panel supporting members 6 with the chassis 2, the component number and the number of assembling steps of the electronic keyboard instrument 100 can be reduced.

In addition, in the electronic keyboard instrument 100, the panel supporting members 6 are arranged in the arrangement spaces S11 formed between two black keys 3B, 3B and two white keys 3W are between the two black keys 3B, 3B. In this way, spaces having a width of two white keys 3W can be secured as the spaces for arranging the panel supporting members 6. As a result, compared with the case when the panel supporting members 6 are arranged in the arrangement spaces S12 formed between two adjacent black keys 3B, 3B and one white key 3W is between the two adjacent black keys 3B, 3B, the panel supporting members 6 can be arranged in wide spaces.

Besides, means for connecting the panel supporting members 6 to the mounting portions 26 is not limited to the fastening members such as the screws, the screw holes or the like, and various means can be employed. For example, the panel supporting members 6 may be connected to the mounting portions 26 by using slits formed in the chassis top walls 21*b* as the mounting portions 26, using insertion strips which can be inserted into the slits as the second connection portions 64 of the panel supporting members 6, and inserting the insertion strips to the slits.

It can be easily inferred that various modifications and improvements can be made to the configurations described in the above embodiment in a scope not departing from the aim. In the above embodiment, a case in which the number of the keys 3 of the electronic keyboard instrument 100 is 88 is described, but the number of the keys 3 is not limited hereto, and the number of the keys 3 may be greater than 89 or smaller than 87.

What is claimed is:

1. An electronic keyboard instrument, comprising:

a plurality of keys which is arrayed comprising a plurality of white keys and a plurality of black keys respectively having a front end and a rear end;

a chassis which is arranged below the plurality of keys and rotatably supports the plurality of keys;

a panel which is arranged above a rear end part of the plurality of keys; and at least one panel supporting member which supports the panel;

wherein the at least one panel supporting member is disposed in spaces formed on an upper surface of the chassis, and the spaces are spaces generated behind rear ends of the white keys between two adjacent black keys.

2. The electronic keyboard instrument according to claim 1, wherein rear ends of the plurality of black keys are positioned behind the rear ends of the plurality of white keys.

3. The electronic keyboard instrument according to claim 1, wherein the panel supporting member is mounted to the upper surface of the chassis using at least one mounting portion formed in the spaces.

4. The electronic keyboard instrument according to claim 1, wherein the panel supporting member is mounted to the upper surface of the chassis using any two mounting portions of a plurality of mounting portions formed in the spaces.

5. The electronic keyboard instrument according to claim 1, wherein the panel supporting member is integrally formed with the chassis and arranged in the spaces.

6. The electronic keyboard instrument according to claim 1, wherein the panel supporting member is detachably mounted to the chassis and arranged in the spaces.

7. The electronic keyboard instrument according to claim 1, wherein pivots of the plurality of black keys are positioned behind pivots of the plurality of white keys.

8. The electronic keyboard instrument according to claim 1, wherein front-rear positions of pivots of the plurality of black keys and pivots of the plurality of white keys are identical.

9. The electronic keyboard instrument according to claim 1, wherein the spaces are arrangement spaces formed between the two adjacent black keys, and two white keys are between the two adjacent black keys.

10. The electronic keyboard instrument according to claim 1, wherein the spaces are arrangement spaces formed between the two adjacent black keys, and one white key is between the two adjacent black keys.

11. A keyboard device, comprising:

a plurality of keys which is arrayed comprising a plurality of white keys and a plurality of black keys respectively having a front end and a rear end;

a chassis which is arranged below the plurality of keys and rotatably supports the plurality of keys; and at least one space which is formed on an upper surface of the chassis and in which at least one panel supporting member for supporting a panel covering rear ends of the plurality of keys is arranged;

wherein the at least one space is a space generated behind a rear end of a white key between two adjacent black keys.

12. The keyboard device according to claim 11, wherein rear ends of the plurality of black keys are positioned behind rear ends of the plurality of white keys.

13. The keyboard device according to claim 11, wherein the panel supporting member is mounted to the upper surface of the chassis using at least one mounting portion formed in the at least one space.

14. The keyboard device according to claim 11, wherein the panel supporting member is mounted to the upper surface of the chassis using any two mounting portions of the plurality of mounting portions formed in the at least one space.

15. The keyboard device according to claim 11, wherein the panel supporting member is integrally formed with the chassis and arranged in the at least one space.

16. The keyboard device according to claim 11, wherein the panel supporting member is detachably mounted to the chassis and arranged in the at least one space.

17. The keyboard device according to claim 11, wherein pivots of the plurality of black keys are positioned behind pivots of the plurality of white keys.

18. The keyboard device according to claim 11, wherein front-rear positions of pivots of the plurality of black keys and pivots of the plurality of white keys are identical.

19. The keyboard device according to claim 11, wherein the at least one space is an arrangement space formed between the two adjacent black keys, and two white keys are between the two adjacent black keys.

20. The keyboard device according to claim 11, wherein the at least one space is an arrangement space formed between the two adjacent black keys and one white key is between the two adjacent black keys.

* * * * *